US010407197B2

(12) United States Patent
Ehrmann

(10) Patent No.: US 10,407,197 B2
(45) Date of Patent: Sep. 10, 2019

(54) THERMO-FORMING PACKAGING MACHINE

(71) Applicant: MULTIVAC Sepp Haggenmüller SE & Co. KG, Wolfertschwenden (DE)

(72) Inventor: Elmar Ehrmann, Bad Grönenbach (DE)

(73) Assignee: Multivac Sepp Haggenmüller SE & Co. KG, Wolfertschwenden (DE)

( * ) Notice: Subject to any disclaimer, the term of this patent is extended or adjusted under 35 U.S.C. 154(b) by 513 days.

(21) Appl. No.: 15/216,140

(22) Filed: Jul. 21, 2016

(65) Prior Publication Data

US 2017/0021955 A1 Jan. 26, 2017

(30) Foreign Application Priority Data

Jul. 24, 2015 (EP) ..... 15178183

(51) Int. Cl.

| | |
|---|---|
| ***B65B 47/02*** | (2006.01) |
| ***B65B 9/04*** | (2006.01) |
| ***B65B 47/00*** | (2006.01) |
| *B65B 31/00* | (2006.01) |
| *B65B 61/06* | (2006.01) |
| *B65B 61/28* | (2006.01) |

(52) U.S. Cl.

CPC ..... *B65B 47/02* (2013.01); *B65B 9/04* (2013.01); *B65B 9/045* (2013.01); *B65B 47/00* (2013.01); *B65B 31/00* (2013.01); *B65B 61/06* (2013.01); *B65B 61/28* (2013.01)

(58) Field of Classification Search

CPC ..... B65B 47/02; B65B 47/00; B65B 9/04; B65B 9/045

USPC ..... 53/453

See application file for complete search history.

(56) References Cited

U.S. PATENT DOCUMENTS

| | | | | |
|---|---|---|---|---|
| 4,862,676 | A * | 9/1989 | Mancini | B65B 9/042 53/453 |
| 6,282,866 | B1 * | 9/2001 | Natterer | B65B 7/164 198/833 |
| 2006/0230708 | A1 * | 10/2006 | Granili | B65B 9/045 53/427 |

(Continued)

FOREIGN PATENT DOCUMENTS

| | | |
|---|---|---|
| DE | 2337730 A1 | 2/1975 |
| EP | 0270208 A1 | 6/1988 |

(Continued)

*Primary Examiner* — Michelle Lopez
*Assistant Examiner* — Chinyere J Rushing-Tucker
(74) *Attorney, Agent, or Firm* — Husch Blackwell LLP

(57) ABSTRACT

The thermo-forming packaging machine according to one embodiment of the present invention comprises a sealing station, a first forming station for forming trays into a lower film web that is in a first forming plane clamped in the first forming station, and a second forming station for forming lids into an upper film web that is in a second forming plane clamped in the second forming station. The sealing station can be configured to create a sealing seam in a sealing plane. The thermo-forming packaging machine may be characterized in that the first forming plane is provided at least 200 mm below the second forming plane, wherein the first and the second forming planes are at least approximately parallel to each other.

11 Claims, 1 Drawing Sheet

(56) References Cited

U.S. PATENT DOCUMENTS

| | | | | |
|---|---|---|---|---|
| 2007/0092611 | A1* | 4/2007 | Hinze | B65D 43/021 426/129 |
| 2009/0272073 | A1* | 11/2009 | Meyer | B29B 13/023 53/141 |
| 2010/0242411 | A1* | 9/2010 | Boekstegers | B65B 7/165 53/449 |
| 2011/0271643 | A1* | 11/2011 | Grimm | B65B 7/162 53/403 |
| 2012/0036815 | A1* | 2/2012 | Holzem | B65B 7/162 53/456 |
| 2015/0096263 | A1* | 4/2015 | Ehrmann | B65B 9/04 53/411 |
| 2015/0203223 | A1* | 7/2015 | Ehrmann | B65B 31/02 493/52 |
| 2015/0367971 | A1* | 12/2015 | Grimm | B65B 31/021 53/453 |
| 2018/0118383 | A1* | 5/2018 | Ehrmann | B65B 9/04 |

FOREIGN PATENT DOCUMENTS

| | | | |
|---|---|---|---|
| EP | 2412632 | A1 | 2/2012 |
| EP | 2412643 | A1 | 2/2012 |
| WO | 2004000650 | A1 | 12/2003 |

* cited by examiner

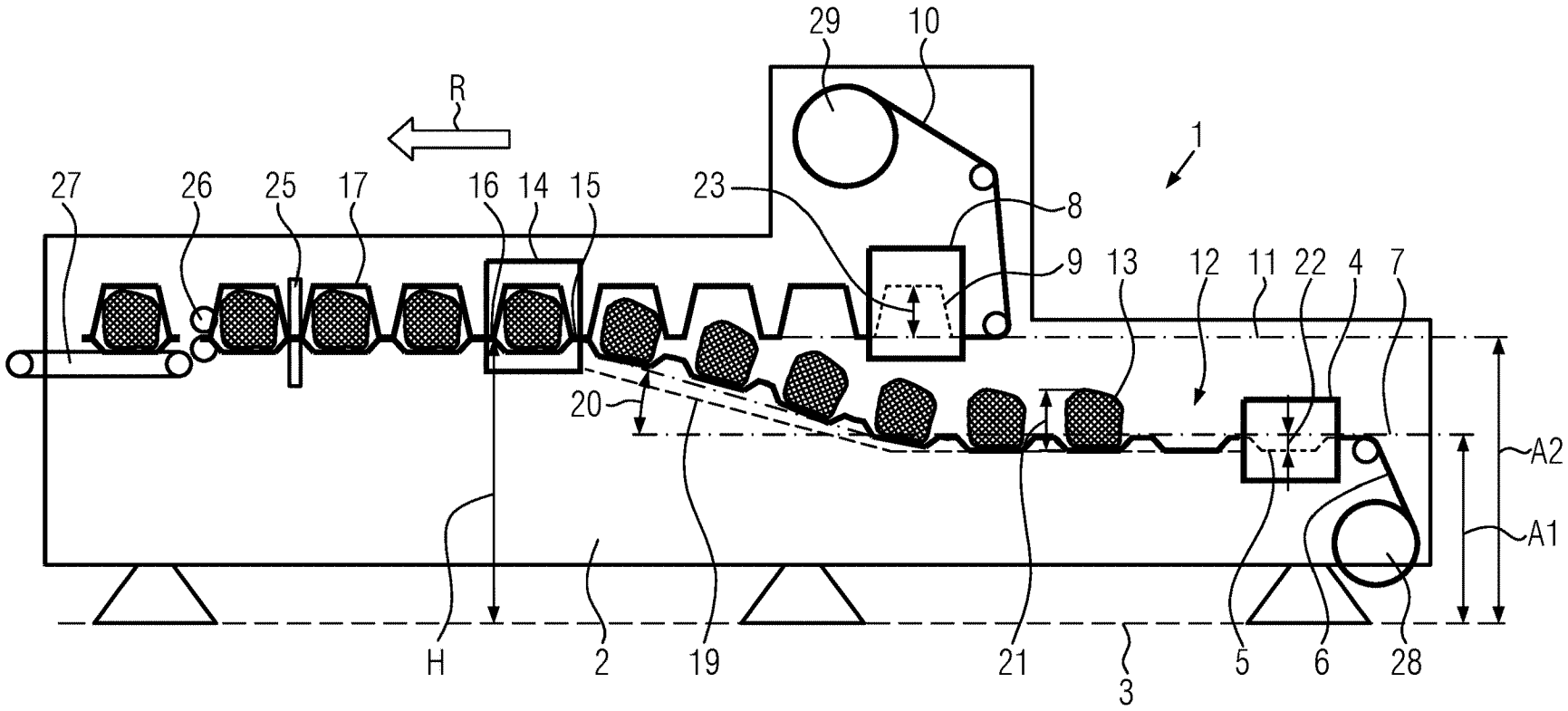
1
2
3
4
5
6
7
8
9
10
11
12
13
14
15
16
17
19
20
21
22
23
25
26
27
28
29
A1
A2
H
R

THERMO-FORMING PACKAGING MACHINE

CROSS-REFERENCE TO RELATED APPLICATIONS

This Application claims priority to European Patent Application Number 15178183.8 filed Jul. 24, 2015, to Elmar Ehrmann, currently pending, the entire disclosure of which is incorporated herein by reference.

FIELD OF THE INVENTION

The invention relates to a thermo-forming packaging machine and to a method.

BACKGROUND OF THE INVENTION

EP 0 270 208 A1 discloses a thermo-forming packaging machine with a sealing station in which an upper film is deformed upwardly and heated in a first part of the tool upper part of the sealing station. The upper film subsequently in part bears closely against the product. In the next process step, the upper film is deformed upwardly and heated in a second part of the tool upper part. A package is subsequently created in which the upper film, being embodied as a skin film or a so-called "Darfresh" film, bears closely against both the product as well as against the inner surfaces of a lower film formed into a tray. This results in a visually appealing product package. However, no packages with a product protruding far beyond a sealing edge of the lower film and having a lid formed into the upper film are producible with this embodiment of the sealing station because the first part of the tool upper part is unsuitable for this.

A thermo-forming packaging machine is known from EP 2 412 632 A1 in which the forming station is not provided in the same plane as the sealing station in order to improve loading products into a tray that is formed into a lower film. Lids formed into the upper film are not provided.

A thermo-forming packaging machine is known from EP 2 412 643 A1, which discloses a forming station for a lower film and a forming station for an upper film, that is able to package products that extend beyond a sealing plane and therefore beyond the tray of the lower film. A chain guide for the lower film is provided having two laterally disposed clamp chains and being oriented in a straight line and horizontally. The upper film forming station is provided above and inclined relative to the chain guide of the lower film. The upper film is with its molded lids shortly upstream of the sealing station deflected from a steeply downwardly oriented direction to a horizontal one and placed on the lower film for sealing. This strong deflection allows for only small forming depths of the lid or only small and thereby easily flexible film thicknesses, for example, up to 300 microns.

One disadvantage with this thermo-forming packaging machine is that it cannot produce rigid packages with a small forming depth of the trays in the lower film and a product protruding far upwardly beyond the tray with a rigid lid that is formed into the upper film.

SUMMARY OF THE INVENTION

The object of the present invention is to provide an improved thermo-forming packaging machine which allows being able to produce the above-mentioned packages.

The thermo-forming packaging machine according to one embodiment of the present invention comprises a sealing station, a first forming station for forming trays into a lower film web that is clamped in the first forming station in a first forming plane and a second forming station for forming lids into an upper film web that is clamped in the second forming station in a second forming plane, where the sealing station is configured to create a sealing seam in a sealing plane. The thermo-forming packaging machine according to one embodiment is characterized in that the first forming plane is provided at least 200 mm below the second forming plane, where the first and the second forming planes are at least approximately parallel to each other. This enables the production of a package having a rigid lid with products that protrude far beyond the tray edge of the lower tray. Film thicknesses from 300 μm are considered to be rigid. Feed belts for supplying and/or loading products above the first forming station can at the same time have a simpler design, because the first forming station is located lower than in conventional thermo-forming packaging machines.

As used herein, the phrase "at least approximately parallel" means that the two forming planes are either exactly oriented in parallel to one another or deviate by a maximum of +/−5° from exact parallelism. This also applies in analogy for the positional relationship between the first forming plane and the sealing plane.

The sealing plane can be provided at one height relative to a floor on which the thermo-forming packaging machine is arranged, and the second forming plane can be provided at least approximately (e.g., up to +/−5 mm) at the same height or above the height of the sealing plane in order to obtain a compact packaging machine, wherein the distance between the second forming station and the sealing station can be kept small.

The first forming plane may be oriented parallel to the sealing plane in order to enable a horizontal transport direction to the greatest possible extent and thereby a simple design of the chain guides.

In one embodiment, a second forming depth of the second forming station is at least twice the first forming depth of the first forming station.

For example, the first forming depth can be up to 20 mm, and the second forming depth can be least 50 mm, and in one instance about 80 mm.

A chain guide may be provided for intermittently transporting the lower film web and the chain guide between the first forming station and the sealing station and having an inclination which is configured to ascend from the first forming station to the sealing station. The product loaded into the tray and protruding beyond the tray can thereby in the region upstream of the sealing station dip upwardly into the already molded lid or be run thereinto.

The inclination of the chain guide can be provided in the direction of production downstream of a loading stretch in order to conduct the loading of products in an ergonomically advantageous, namely horizontally-oriented, manner.

The loading stretch for loading products into the trays of the lower film web may be provided in the direction of production downstream of the first forming station.

A method according to one embodiment of the present invention for operating a thermo-forming packaging machine, which comprises a sealing station, a first forming station for forming trays into a lower film web transported in a first forming plane in the first forming station and a second forming station for forming lids into an upper film web transported in a second forming plane in the second forming station, where the sealing station creates a sealing seam in a sealing plane, is characterized in that a product is loaded into the tray and the tray is then together with the product approached upwardly toward the lid by way of an inclined chain guide for the lower film web. The upward motion of the tray in the vertical direction can be at least 200 mm.

Other and further objects of the invention, together with the features of novelty appurtenant thereto, will appear in the course of the following description.

DESCRIPTION OF THE SEVERAL VIEWS OF THE DRAWING

In the following, an advantageous embodiment of the invention is further illustrated using a drawing. The individual FIGURE shows:

FIG. 1 is a schematic side view of a thermo-forming packaging machine according to one embodiment of the present invention.

DETAILED DESCRIPTION OF THE INVENTION

The invention will now be described with reference to the drawing FIGURES, in which like reference numerals refer to like parts throughout. For purposes of clarity in illustrating the characteristics of the present invention, proportional relationships of the elements have not necessarily been maintained in the drawing FIGURES.

The following detailed description of the invention references specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is defined by the appended claims and the description is, therefore, not to be taken in a limiting sense and shall not limit the scope of equivalents to which such claims are entitled.

FIG. 1 shows a schematic side view of a thermo-forming packaging machine 1 according to one embodiment of the present invention, the direction of production R of which runs from right to left. As illustrated, the thermo-forming packaging machine 1 is standing with its machine frame 2 on a floor surface 3, such as a building floor. Thermo-forming packaging machine 1 can comprise a first forming station 4 for forming trays 5 into a lower film web 6. A first forming plane 7 of first forming station 4 may be located at a vertical first distance A1 from floor surface 3 and parallel thereto, i.e., normally horizontally. First forming plane 7 is defined as the plane in which the lower film web 6 is circumferentially clamped within first forming station 4 after closing forming station 4.

A second forming station 8 can be provided in the direction of production R downstream of first forming station 4 for forming lids 9 into an upper film web 10. A second forming plane 11 of second forming station 8 may be located at a vertical second distance A2 from floor surface 3 and generally parallel thereto. Second forming plane 11 is defined as the plane in which the circumferentially-clamped upper film web 10 is located within second forming station 8 after the closing of second forming station 8. Second forming plane 11 is in parallel offset relative to first forming plane 7 and disposed higher, namely by at least 200 mm, for example. For firmly clamping respective film webs 6, 10, first forming station 4 and second forming station 8 each have an upper and a lower tool which can be brought from an open position to the closed position shown in FIG. 1. In the closed position, the two forming tools clamp the respective lower or upper film webs 6, 10 between them.

A loading stretch 12 is provided in top view between the two forming stations 4, 8 for loading one or more products 13 into a tray 5 of lower film web 6 that is formed or deep-drawn downwardly. This can be performed manually by one or more operators or by a loading device.

Disposed downstream of the two forming stations 4, 8 is a sealing station 14, the sealing plane 15 of which is defined as the plane in which a circumferentially-clamped lower film web 6 and upper film web 10 are located or bear against one another within sealing station 14 when sealing station 14 is closed. Sealing plane 15, in which sealing seam 16 connecting both films is produced in sealable upper and lower film web 6, 10, together with second forming plane 11 can form a common plane. Sealing plane 15 is at a vertical height H spaced from floor surface 3. Lid 9 is heat-sealed to tray 5 in sealing station 14 in an air-tight manner along sealing seam 16 which is respectively created on a flange at lid 9 and at tray 5. The interior of a package 17 thus produced can, prior to sealing, optionally be evacuated in sealing station 14 and/or aerated in order to package product 13 in a modified atmosphere for a long shelf life.

Lower film web 6 may be transported by a chain guide 19 intermittently performing an advance motion. Chain guide 19 can for this purpose on each of the two sides of lower film web 6 respectively comprise a clamp chain which grips lower film web 6 with clamps and stretches it as is generally known from EP 1 816 075 A1, which is incorporated herein by reference. As known from EP 1816075 A1, chain guide 19 can respectively comprise lower and upper plastic strips between which the elements of the clamp chain are guided.

Chain guide 19 of lower film web 6 has an inclination 20 relative to first forming plane 7 upstream of sealing station 14 for approaching tray 5 and lower film web 6, respectively, with product 13 toward lid 9 or upper film web 10, respectively. Inclination 20 may be between 15° and 60°, in one embodiment and between 30° and 45° in another embodiment. Inclination 20 may be influenced by a product height 21, a first forming depth 22 of tray 5, a second forming depth 23 of lid 9, and/or the distance between second forming station 8 and sealing station 14.

First forming depth 22 being produced in first forming station 4 into lower film web 6 is, for example, up to 20 mm. Second forming depth 23 being produced in second forming station 8 into upper film web 10 is, for example, at least 50 mm, and may be 80 mm in one instance, to be able to package products 13 having a product height 21 of, for example, 90 mm. A second forming depth 23 thereby arises at least 2.5 times as large as first forming depth 22.

Packages 17 can be separated by a transverse cutting station 25 disposed downstream of sealing station 14 and a subsequent longitudinal cutting station 26 and removed from thermo-forming packaging machine 1 by way of a transport belt 27 and supplied to a possible downstream workstation. Chain guide 19 can extend at least from loading region 12 to last cutting station 26.

Lower film web 6 may be drawn off from a first film storage 28 and fed to first forming station 4 by way of clamp chains. Upper film web 10 may be drawn off from a second film web storage 29 and fed to second forming station 4. This feeding can also be effected by way of clamp chains. A separate chain guide with such a clamp chain could in particular be configured for the upper film to guide upper film web 10 together with the lids formed therein between the second forming station and sealing station 14. Such a separate chain guide for the upper film in the region between second forming station 8 and sealing station 14 could in an alternative embodiment be omitted. In that case, upper film 10 would be moved along by the intermittent advance motion of lower film 6 by way of chain guide 19 for lower film 6, since upper film web 10 is downstream of sealing station 14 sealed to lower film web 6.

From the foregoing, it will be seen that this invention is one well adapted to attain all the ends and objects hereinabove set forth together with other advantages which are obvious and which are inherent to the structure. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions and methods described above and illustrated in the drawings are presented by way of example only and are not intended to limit the concepts and principles of the present invention. Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. Thermo-forming packaging machine comprising:

a first forming station for forming trays into a lower film web, the first forming station being configured to clamp the lower film web in a first forming plane;

a second forming station for forming lids into an upper film web, the second forming station being configured to clamp the upper film web in a second forming plane; and a sealing station configured for creating a sealing seam in a sealing plane;

a chain guide for intermittently transporting the lower film web, wherein the chain guide between the first forming station and the sealing station has an inclination which is configured to ascend from the first forming station to the sealing station; and wherein the first forming plane is disposed at least 200 mm below the second forming plane, and wherein the first and the second forming planes are approximately parallel to each other.

2. Thermo-forming packaging machine according to claim 1, wherein the sealing plane is provided at a height relative to a floor on which the thermo-forming packaging machine is arranged, and wherein the second forming plane is provided approximately at or above the height of the sealing plane.

3. Thermo-forming packaging machine according to claim 1, wherein the first forming plane is oriented at least approximately parallel to the sealing plane.

4. Thermo-forming packaging machine according to claim 1, wherein a second forming depth of the second forming station is at least twice that of a first forming depth of the first forming station.

5. Thermo-forming packaging machine according to claim 4, wherein the first forming depth is up to 20 mm and the second forming depth at least 50 mm.

6. Thermo-forming packaging machine according to claim 5, wherein the second forming depth at about 80 mm.

7. Thermo-forming packaging machine according to claim 1, wherein the inclination of the chain guide is provided in a direction of production downstream of a loading stretch.

8. Thermo-forming packaging machine according to claim 1, wherein a loading stretch for loading products into the trays of the lower film web is provided in a direction of production downstream of the first forming station.

9. Method for operating a thermo-forming packaging machine, the method comprising the steps of:

clamping a lower film web in a first forming plane;

forming a tray into the lower film web in a first forming station;

loading a product into the tray;

clamping an upper film web in a second forming plane;

forming a lid into the upper film web in a second forming station;

moving the tray with the product therein upwardly to the lid by way of an inclined chain guide for the lower film web; and creating a sealing seam in a sealing plane in a sealing station.

10. Thermo-forming packaging machine comprising:

a first forming station for forming trays into a lower film web, the first forming station being configured to clamp the lower film web in a first forming plane;

a second forming station for forming lids into an upper film web, the second forming station being configured to clamp the upper film web in a second forming plane; and a sealing station configured for creating a sealing seam in a sealing plane;

wherein the first forming plane is disposed at least 200 mm below the second forming plane, and wherein the first and the second forming planes are approximately parallel to each other; and wherein the sealing plane is provided at a height relative to a floor on which the thermo-forming packaging machine is arranged, and wherein the second forming plane is provided at a height proximate the height of the sealing plane.

11. Thermo-forming packaging machine according to claim 10, wherein the second forming plane is provided at the height of the sealing plane.

* * * * *